US007895680B2

(12) United States Patent
Anderson

(10) Patent No.: US 7,895,680 B2
(45) Date of Patent: Mar. 1, 2011

(54) PROTECTIVE MASK HAVING REMOVABLE LENS AND DETACHABLE HEAD STRAP

(76) Inventor: Kenneth K. Anderson, Newport Beach, CA (US)

( * ) Notice: Subject to any disclaimer, the term of this patent is extended or adjusted under 35 U.S.C. 154(b) by 1053 days.

(21) Appl. No.: 11/705,121

(22) Filed: Feb. 12, 2007

(65) Prior Publication Data

US 2008/0189821 A1 Aug. 14, 2008

(51) Int. Cl.
*A61F 9/02* (2006.01)

(52) U.S. Cl. ..... 2/452; 2/427

(58) Field of Classification Search ..... 2/410, 6.3, 2/6.7, 425, 10, 427, 429, 430, 418, 417
See application file for complete search history.

(56) References Cited

U.S. PATENT DOCUMENTS

| | | | | |
|---|---|---|---|---|
| 4,653,124 | A * | 3/1987 | McNeal et al. | 2/427 |
| 5,005,221 | A * | 4/1991 | Chen | 2/424 |
| 5,091,997 | A * | 3/1992 | Foehl | 2/424 |
| 5,148,550 | A * | 9/1992 | Hodgkinson et al. | 2/424 |
| 6,276,795 | B1 | 8/2001 | Hall et al. | |
| 6,363,528 | B1 * | 4/2002 | Cyr | 2/9 |
| 6,381,749 | B1 * | 5/2002 | Cyr | 2/9 |
| 6,789,273 | B2 | 9/2004 | Markovitz | |
| 6,948,813 | B2 * | 9/2005 | Parks | 351/158 |
| 7,003,802 | B2 * | 2/2006 | Broersma | 2/9 |
| 2007/0050896 | A1 * | 3/2007 | Stevens | 2/427 |
| 2009/0113607 | A1 * | 5/2009 | Lian | 2/427 |

* cited by examiner

*Primary Examiner* — Gary L Welch
*Assistant Examiner* — Sally C Cline
(74) *Attorney, Agent, or Firm* — Morland C. Fischer

(57) ABSTRACT

Disclosed is a protective mask of the kind having particular application for covering the eyes, ears, nose and chin of one playing the game of paintball. The protective mask has a lens that can be quickly and easily removed for replacement as a consequence of paint splatter or cracking such as that caused by the impact thereagainst of a paintball traveling at high speed. The protective mask also has a detachable head strap that is coupled to the lens through the mask. More particularly, a hole formed through an ear covering section of the mask is axially aligned with a hole formed through an ear covering section of the removable lens. One end of the detachable head strap is tied to a first connector. The first connector includes an upstanding locking catch that is moved into the axially aligned holes formed through the mask and the lens. A quick-release second connector has a rotatable latch that is responsive to a manual pushing force applied thereto so as to move into interlocking mating engagement with the locking catch of the first connector. A lock is rotated from an unlocked position to a locked position to prevent the latch of the second connector from moving out of its mating engagement with the locking catch of the first connector. Accordingly, the first and second connectors will remain reliably connected together to prevent a separation of the removable lens and the detachable head strap from the protective mask.

20 Claims, 7 Drawing Sheets

8
42
44
46
48
50
52
54
56
60
62
64
68
74
78
80
28

PROTECTIVE MASK HAVING REMOVABLE LENS AND DETACHABLE HEAD STRAP

BACKGROUND OF THE INVENTION

1. Field of the Invention

This invention relates to a protective mask having particular application for covering the eyes, ears, nose and chin of one playing the game of paintball, and including a removable lens and a detachable head strap that can be quickly and easily separated from the mask.

2. Background Art

The game of paintball is spreading in popularity among players of all ages. During the game, paintballs are projected at high speed from a paintball marker (i.e., gun) towards an opponent with the object of striking the opponent and leaving a tell-tale paint mark when the paintball ruptures on impact. So as to prevent injury to the face, it is common for players to wear protective masks during play. However, such conventional masks are characterized by several shortcomings.

In particular, the vision available to a player through the lens of a conventional protective mask is generally limited to a straight-ahead (i.e., horizontal) field of view. Thus, the player must bend his head and look down to watch his step or spot his opponent. Having to bend one's head may expose the player to an unseen attack from an opponent without the player having sufficient response time to avoid being "shot."

Nevertheless, the eye covering lens of a protective mask may take a direct hit from an exploding paintball. As a consequence of the foregoing, paint splatter is known to travel under the lens to the interior of the mask where the player's vision may be impaired. In other situations the lens may become cracked by the impact force generated by a paintball traveling at high speed and/or covered with paint, such that the player's vision will be blocked. In this case, it would be desirable to remove the lens for purposes of cleaning or replacement. However, it is essential that the player be able to quickly and easily remove the lens from his protective mask so as to avoid wasting time and be ready for the start of a new game. In this same regard, the manner in which the removable lens is attached to the protective mask must be relatively simple to manipulate to facilitate a quick and easy removal thereof. On the other hand, it is equally essential that when the protective mask is in use, the lens is reliably held in place so as to prevent an inadvertent displacement or removal during play.

In this regard, what is desirable is a protective mask having particular application for use during the game of paintball and including a removable lens that is reliably held in place during play but is quickly and easily removable from the mask so as to address the problems listed above and overcome the shortcomings of conventional masks.

Examples of such conventional masks are available by referring to one or more of the following U.S. patents:

| U.S. Pat. No. | Issue Date |
|---|---|
| 5,148,550 | 22 Sep. 1992 |
| 6,276,795 | 21 Aug. 2001 |
| 6,363,528 | 2 Apr. 2002 |
| 6,789,273 | 14 Sep. 2004 |
| 6,948,813 | 27 Sep. 2005 |
| 7,003,802 | 28 Feb. 2006 |

SUMMARY OF THE INVENTION

In general terms, a protective mask is disclosed of the kind to be worn by one playing the game of paintball, or the like. The protective mask herein disclosed covers the eyes, nose, chin and ears of a wearer. The mask includes a detachable head strap and a removable lens, should the lens become cracked or covered with paint and be in need of cleaning or replacement. To this end, the removable lens is of the wrap-around type having a pair of ear covering sections at opposite sides thereof, an upturned notch that is sized to fit over a nose covering portion of the mask, and a pair of eye covering sections at opposite sides of the upturned notch.

The lens is removably attached to the protective mask when the ear covering sections of the lens are slidably received through gaps between outer and inner lens guides at each side of the mask. In the assembled configuration, a head strap connection hole formed in each ear covering section of the lens is axially aligned with an ear hole formed in an ear covering section at each side of the mask. The mask has an open front in which the removable lens is located with the eye covering sections thereof seated in respective deep lens receiving pockets that extend to the cheeks of the wearer. The mask is sculpted with downwardly sloping walls running along the lens receiving pockets. Thus, the wearer's vision will be maximized to include a substantially vertical field of view without the wearer having to bend his head. A rib is molded into the mask around the bottom of each lens receiving pocket to establish a ridge or barrier to prevent paint splatter and solid debris from a ruptured paintball from traveling under the lens and obscuring the vision of the wearer.

Each end of the detachable head strap is tied to a first connector from a pair of connectors that are mated to one another to detachably connect the head strap and the removable lens to the mask. The first connector includes a locking catch that projects inwardly of the mask by way of the axially-aligned ear hole through an ear covering section at one side of the mask and a head strap connection hole through the ear covering section at one side of the lens. The second of the pair of connectors is manipulated against the first connector and includes a rotatable latch having a force-receiving pad at one end and a force-responsive tail at the opposite end. A manual pushing force applied by the wearer to the force-receiving pad of the latch of the second connector causes the force-responsive tail to rotate around a pin and into interlocking mating engagement with the locking catch of the first connector, whereby the first and second connectors are coupled together to prevent a detachment of the head strap and a separation of the removable lens from the protective mask.

A locking screw is received through a hole in the force-receiving pad of the latch of the second connector. The locking screw is rotated by the wearer from an unlocked position to a locked position at which to prevent the force-responsive tail of the latch from moving out of its interlocking mating engagement with the locking catch of the first connector so that the first and second connectors will be held together. When it is desirable to separate the lens and the head strap from the mask, the locking screw is rotated to the unlocked position to enable the force-responsive tail of the latch to move out of its interlocking mating engagement with the locking catch, whereby the first and second connectors may now be disengaged from one another.

DESCRIPTION OF THE PREFERRED EMBODIMENT

Figure 1:
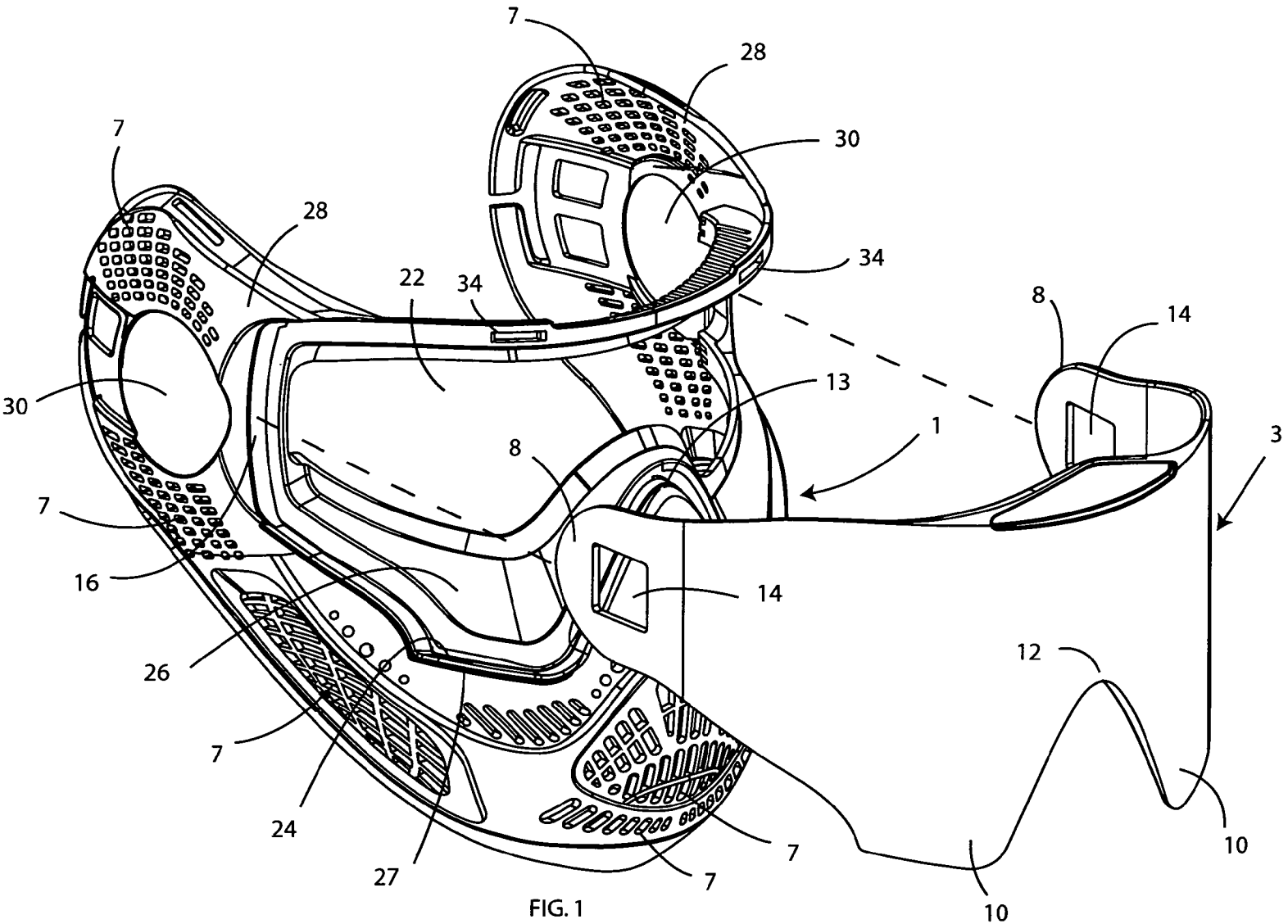
FIG. 1 shows a protective mask according to a preferred embodiment of the present invention having a removable lens for slidable receipt at opposite sides of the mask.
Figure 2:
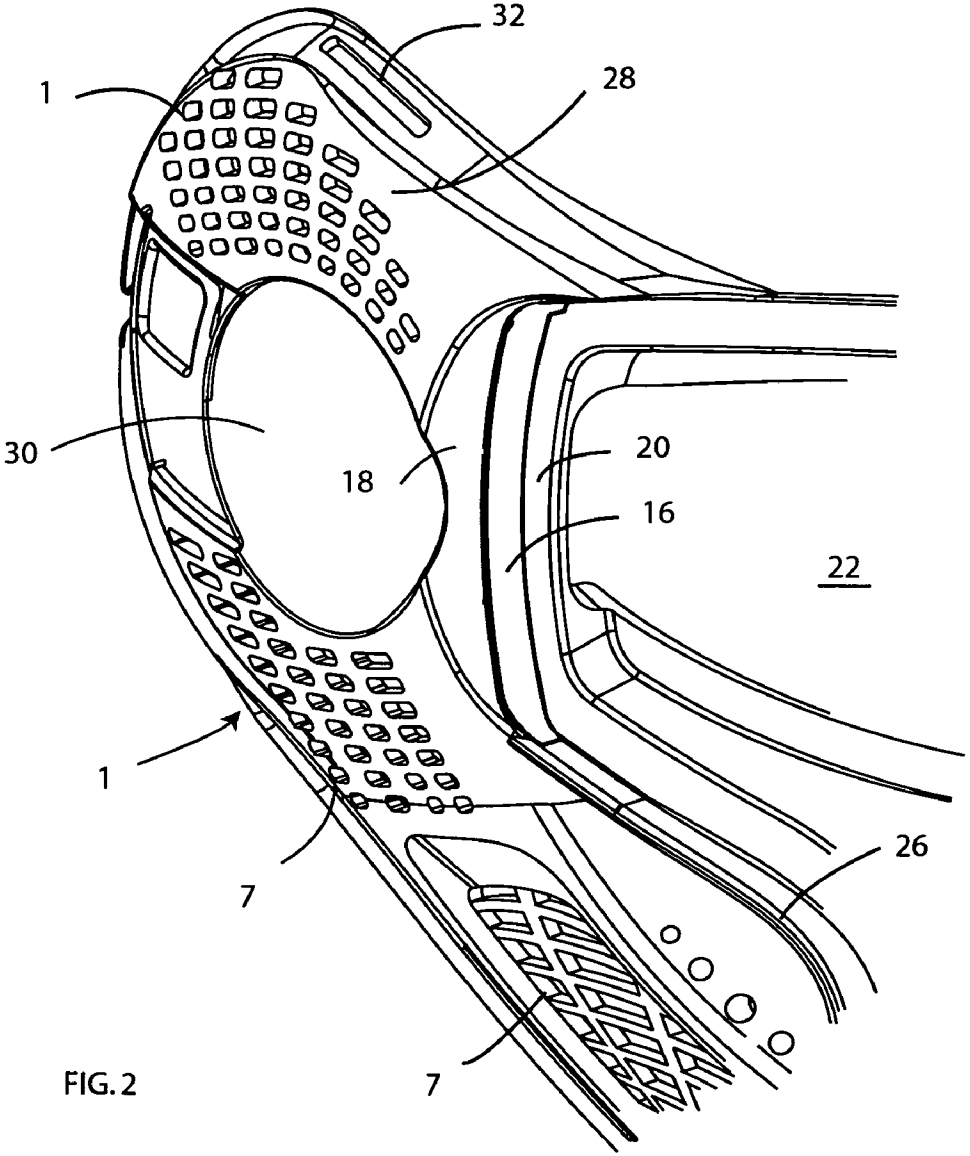
FIG. 2 is an enlarged detail showing one side of the protective mask of FIG. 1 with the removable lens slidably received thereby.

Referring initially to FIGS. 1, 2, 3A and 3B of the drawings, there is shown a protective mask 1 having a removable lens 3, an adjustable and detachable head strap 5, and a visor 6 according to the preferred embodiment of this invention. Although it is contemplated that the protective mask 1 will have particular application to be worn by those who play the game of paintball, the mask 1 herein disclosed can be used to protect the face of others who are engaged in different recreational activities.

The protective mask 1 and the visor 6 (best shown in FIGS. 3A and 3B) are preferably manufactured (e.g., molded) from a lightweight (e.g. polyethylene) material. A number of air holes 7 are formed throughout the mask 1 to provide ventilation around the face and improve the wearer's ability to speak and hear. To provide maximum protection while being worn during the game of paintball, the mask 1 is sized to surround the nose, chin, eyes and ears of the wearer.

The removable lens 3 which covers the eyes of the wearer is shown in FIG. 1 removed from the front of the mask 1. In the present example, the lens 3 is manufactured from an impact-resistant (e.g., polycarbonate) material. The lens 3 is of the wrap-around type so as to have a pair of extended length ear covering sections 8 at opposite sides thereof that project rearwardly from a pair of eye covering sections 10 located at the front of lens 3. An upturned notch 12 is formed in the front of the lens 3 between the pair of eye covering sections 10 within which to receive the nose covering portion 13 of the mask 1. A head strap connection hole 14 is formed through each of the ear covering sections 8 of the lens 3 for a purpose that will soon be explained. Although they are shown as being square, connection holes 14 may have any suitable shape depending upon the means by which the lens 3 and the head strap 5 are connected to the mask 1.

The lens 3 is removably connected to the front of the protective mask 1 when the ear covering sections 8 thereof are slidably received through respective gaps 16 (best shown in FIG. 2) that are established at opposite sides of the mask between an outer lens guide 18 and an inner lens guide 20. In the fully assembled relationship shown in FIG. 3B, the lens 3 fills the open front 22 of the mask 1 so as to cover the eyes of the wearer. At the same time, the head strap connection holes 14 are accessible so that the detachable head strap 5 can be coupled to the lens 3 in a manner that will soon be described. In this same regard, and provided that the head strap 5 has first been detached from the mask 1, the removable lens 3 can be quickly and easily separated from the mask in response to a pulling force applied thereto such that the ear covering sections 8 are slidably withdrawn from the gaps 16 between the outer and inner lens retaining guides 18 and 20 at each side of the mask. This quick release, slide-out feature advantageously allows one lens which has been cracked or covered with vision-blocking paint splatter during the paintball game to be removed and replaced in a few seconds with a new lens to avoid wasting time between games.

When the removable lens 3 is attached to the protective mask 1, the upturned notch 12 between the eye covering sections 10 will be seated upon the outwardly protruding portion 13 of the mask that covers the wearer's nose. As another important advantage of the removable lens 3 herein disclosed, the eye covering sections 10 depend downwardly from the upturned notch 12 (e.g., by approximately 6 cm) so as to terminate adjacent the wearer's cheeks. To this end, the front of the mask 1 is provided with a pair of deep lens receiving pockets 24 (best shown in FIG. 1) lying opposite the nose covering portion 13 that extend below the cheeks of the wearer to accommodate respective ones of the eye covering sections 10 of lens 3. What is more, the front of the mask 1 is sculpted with a downwardly and outwardly sloping wall 26 that runs between the nose covering portion 13 and the end of each deep lens receiving pocket 24 to provide the wearer with a substantially vertical line of sight through the lens 3. Such a vertical line of sight along the sloping walls 26 enables the wearer to better view the ground and/or the feet of an opponent who is engaged in the game of paintball without first having to bend his head. On the other hand, the lens of a conventional mask is typically sized and fitted to the mask body such that the wearer's vision is undesirably limited to a substantially horizontal line of sight.

A rib 27 is molded into the front of the protective mask 1 to follow the contour of the lens receiving pockets 24 at each side of the nose covering portion 13. In the assembled configuration, when the ear covering sections 8 of lens 3 are slidably received through the lens receiving gaps 16 at the opposite sides of the mask 1, each eye covering section 10 at the bottom of the lens 3 is seated upon a rib 27. The rib 27 provides the advantage of introducing a guard or barrier to prevent a spurt of paint and solid debris from an exploding paintball from traveling under the lens 3 and possibly blocking the vision of the wearer. The rib 27 also blocks any gap that might be created below the lens should the mask flex under pressure during play.

Figure 4:
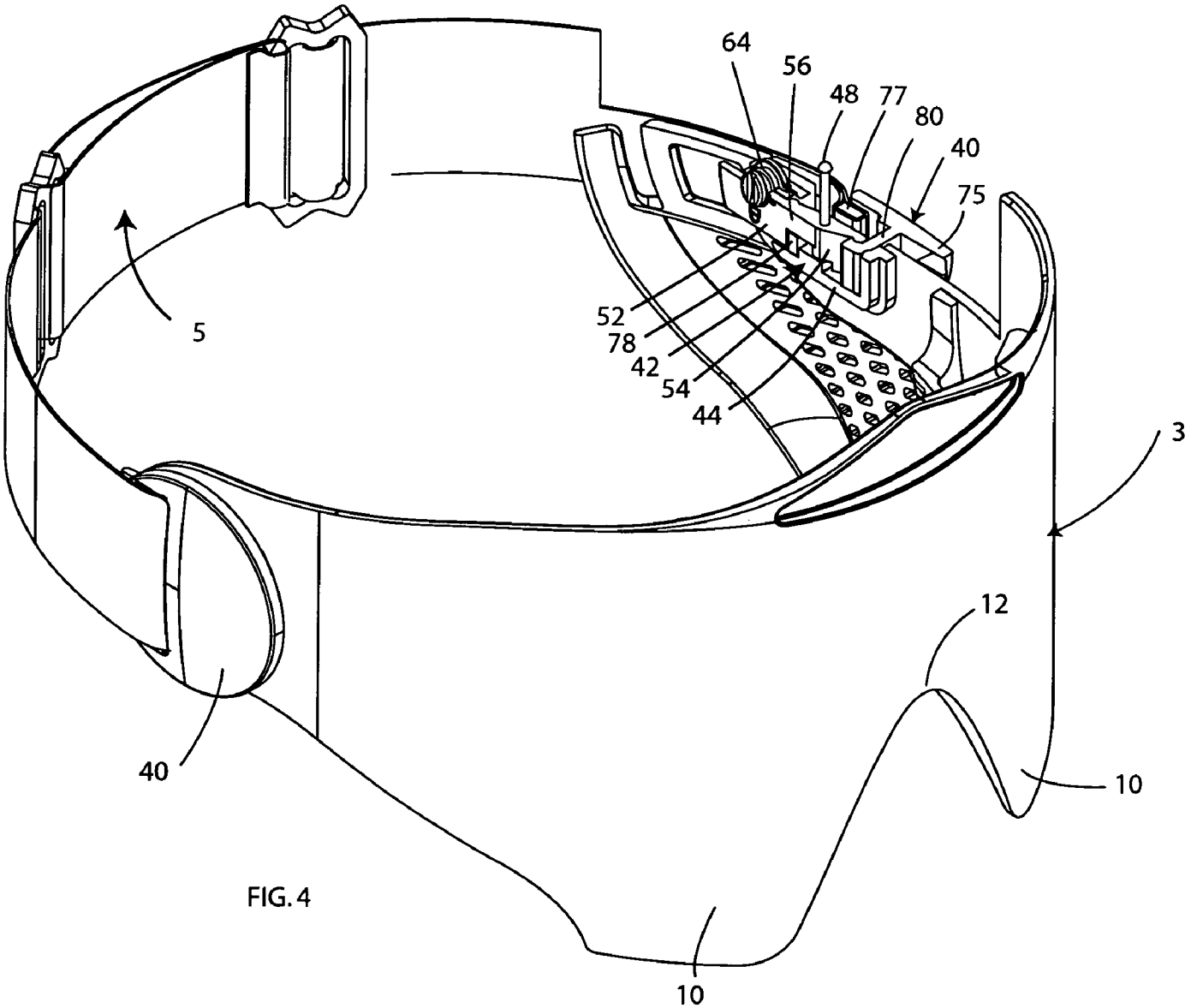
FIG. 4 shows the detachable head strap of the protective mask detachably connected to the removable lens thereof with the first and second connectors of FIG. 3A moved into mating engagement with one another.

A (e.g., round) ear hole 30 is formed through each one of a pair of ear covering sections 28 located at opposite sides of the protective mask 1. With the removable lens 3 attached to the protective mask 1, the ear covering sections 8 and 28 lie face-to-face one another such that each head strap connection hole 14 through an ear covering section 8 of lens 3 will be axially aligned with an ear hole 30 through an ear covering section 28 of mask 1. As will soon be explained, and as is best shown in FIG. 4, opposite ends of the head strap 5 are detachably connected to the lens 3 by pairs of connectors 40 and 42 that are mated to one another through the axially aligned head strap connection holes 14 and ear holes 30 at opposite sides of mask 1, whereby to prevent an inadvertent removal of lens 3 from the mask.

The visor 6 (of FIGS. 3A and 3B) is attached to the top of the protective mask 1 to shade the eyes of the wearer. The visor 6 also serves as a shield to intercept paintballs that are directed downwardly toward the mask 1 and the lens 3 carried thereby. As is best shown in FIG. 1, a locking slot 32 is formed in the top of the mask 1 at each of the ear covering sections 28.

Additional locking slots 34 are formed in the top of the mask above the open front 22 thereof in which the removable lens 3 is located. In the assembled configuration, detents 36 projecting from the visor 6 are snapped into locking engagement with respective ones of the locking slots 32 and 34 around the mask 1 so that the visor 6 will be reliably connected to the top of mask and suspended outwardly therefrom above the lens 3.

In the assembled ready-to-wear configuration, each of the opposite ends of the detachable head strap 5 is shown coupled to the removable lens 3 via an axially aligned ear hole 30 (of FIG. 1) through an ear covering section 28 at one side of mask 1 and a head strap connection hole 14 (also of FIG. 1) through an ear covering section 8 of lens 3. More particularly, and as will be disclosed in greater detail while referring hereinafter to FIGS. 6A-6C, a first connector 40 of one of the aforementioned pairs of connectors to which one end of the head strap 5 is tied is pushed by the wearer through an axially aligned ear hole 30 and head strap connection hole 14. A quick-release second connector 42 is detachably connected by the wearer inside mask 1 to the first connector 40, whereby to lock the head strap 5 to the lens 3 (best shown in FIG. 4) through the mask.

Figure 3A:
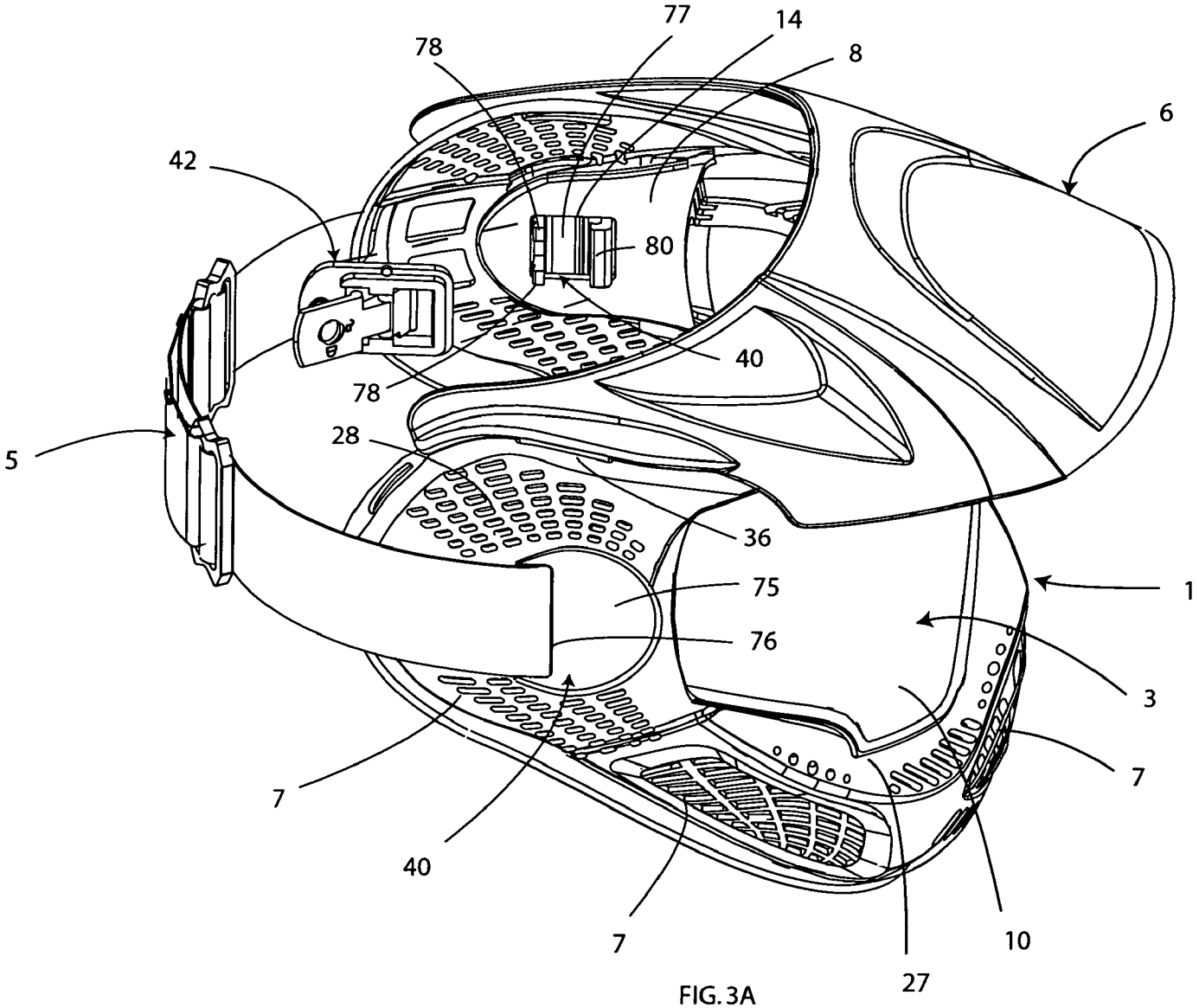
FIG. 3A shows the protective mask having first and second connectors disconnected from one another.
Figure 3B:
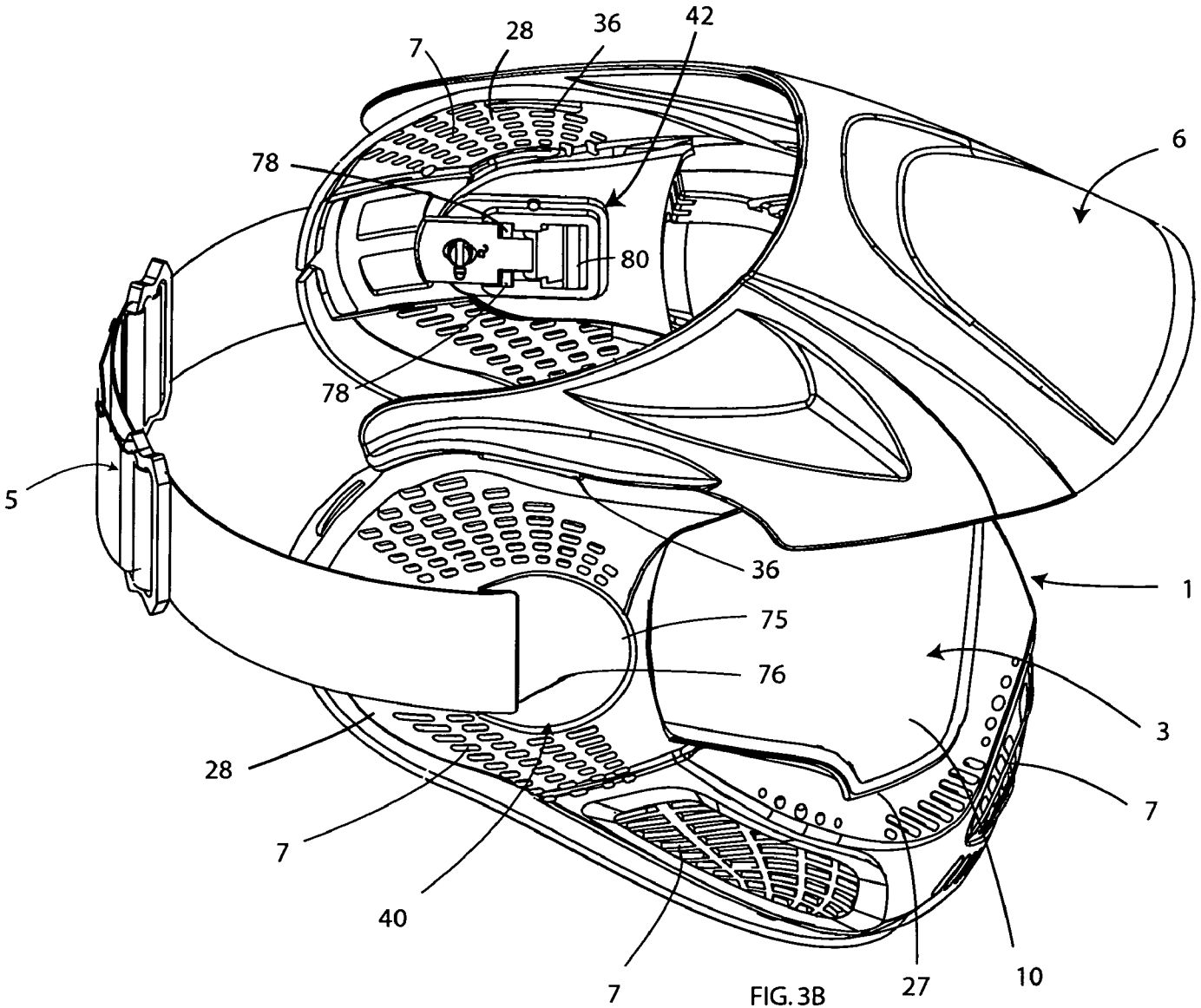
FIG. 3B shows the protective mask in the fully assembled configuration having the removable lens, a detachable head strap, and a visor projecting outwardly from the mask and suspended above the lens.

Details of the first connector 40 to be connected to an opposing quick-release second connector 42 through the protective mask 1 are provided while referring to FIG. 3A of the drawings. As previously described, each end of the detachable head strap 5 is tied to a connector 40. In particular, the first connector 40 includes a (e.g., round) backing 75 that is sized and shaped to be seated within a correspondingly shaped ear hole 30 (of FIG. 1) through the ear covering section 28 at one side of the mask 1. The head strap 5 is fed through a slot 76 in the backing 75 to be turned back upon itself and stitched together to establish a wide loop end 77.

A pair of spaced neck support fingers 78 stand upwardly from one end of the backing 75 of connector 40, and a hook-shaped locking catch 80 stands upwardly from the opposite end of backing 75. With the backing 75 of connector 40 seated within ear hole 30, the pair of neck support fingers 78 and the locking catch 80 project inwardly of the protective mask 1 via the axially aligned ear hole 30 through ear covering section 28 of the mask 1 and the head strap connection hole 14 through the ear covering section 8 of removable lens 3. The quick-release second connector 42 can now be moved by the wearer into mating engagement with the first connector 40 at the inwardly projecting neck support fingers 78 and locking catch 80 thereof in the manner shown at FIG. 3B.

Figure 5:
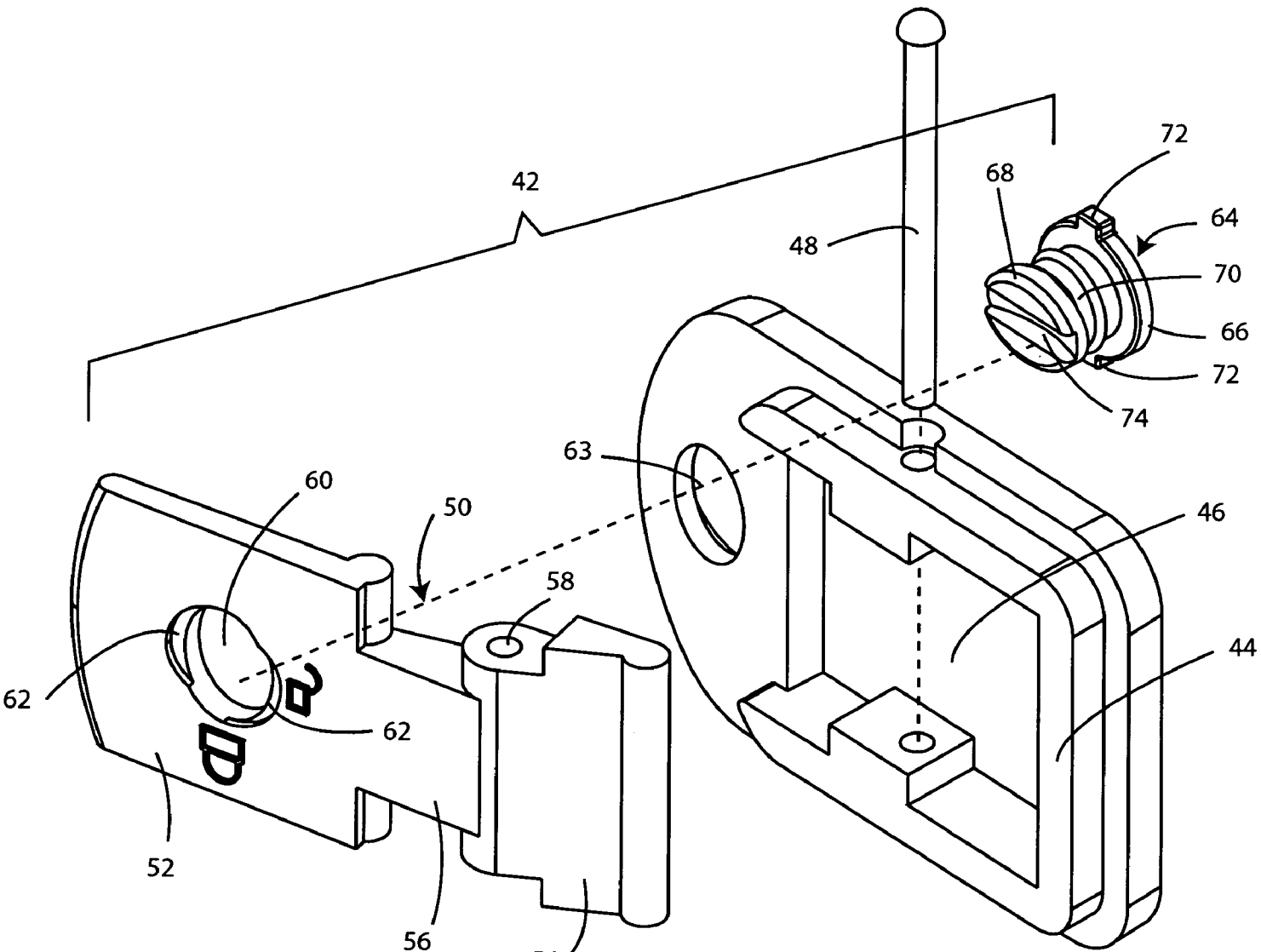
FIG. 5 shows details of the second connector to be mated to the first connector by which the detachable head strap and the removable lens are connected to one another.

Details of the quick-release second connector 42 which is to be coupled to an opposing first connector 40 to prevent the lens 3 and the head strap 5 from becoming disconnected from one another and separated from the protective mask 1 are provided while referring concurrently to FIGS. 4 and 5 of the drawings. The quick-release second connector 42 is complementary to but independent of the first connector 40 to which one of the ends of the head strap 5 is tied. That is, the quick-release connector 42 can be disconnected from the first connector 40 and separated from mask 1.

FIG. 5 shows an exploded view of the quick-release connector 42. A rectangular base 44 of connector 42 surrounds an open window 46. A pin 48 extends transversely and downwardly through the open window 46 to be supported at opposite ends thereof by the base 44. A latch 50 is pivotally coupled to the pin 48, whereby the latch 50 is rotatable relative to the base 44. In particular, the latch 50 is adapted to rotate around the pin 48 so as to move through the window 46 between latched and unlatched positions.

The latch 50 of quick-release connector 42 includes a force receiving pad 52 at one end thereof, a force responsive tail 54 at the opposite end, and a neck 56 extending therebetween. A cylindrical hole 58 runs longitudinally through the tail 54 of latch 50. When the latch 50 is coupled to the base 44 of connector 42, the pin 48 is received through the hole 58 in tail 54 to enable the latch 50 to rotate through the window 46 of base 44.

A generally oval-shaped hole 60 is formed in the force receiving pad 52 of latch 50. The oval-shaped hole 60 has a recessed lip 62 formed at each of its relatively narrow sides along the minor axis thereof. A generally oval-shaped hole 63, which conforms to the size and shape of the hole 60 in latch 50 is formed through the base 44. However, the major axes of the oval-shaped hole 60 formed in the force receiving pad 52 and the oval-shaped hole 63 formed in the base 44 of connector 42 are aligned perpendicular to one another.

A locking screw 64 has a first head 66 at one end thereof, a second head 68 at the opposite end, and a relatively narrow shank 70 extending between the first and second heads 66 and 68. The second head 68 of locking screw 64 has an oval shape to conform to the shape of the holes 60 and 63 that are formed in latch 50 and base 44. In the coupled connector configuration of FIG. 4, the shank 70 of locking screw 64 is rotatably received through the hole 63 in base 44, such that the first head 66 of the locking screw 64 is located above the base 44, and the second (oval-shaped) head 68 is located below the base 44.

A pair of guide tabs 72 project outwardly from opposite sides of the first head 66 of locking screw 64. A force transmitting slot 74 is formed in the second head 68 of locking screw 64. In the coupled connector configuration (of FIG. 4) and as will be explained when referring to FIG. 6, a coin or a tool is located within the force-transmitting slot 74 of head 68. A rotational force applied to slot 74 is transferred from the second head 68 to the first head 66 by way of the shank 70 of locking screw 64. Accordingly, the locking screw 64 will rotate within the oval-shaped hole 63 that is formed in the base 44 of the quick-release connector 42. At the same time, the oval-shaped second head 68 of locking screw 64 can be rotated (relative to the oval-shaped hole 60 that is formed in the latch 50) between a locked position (when the removable lens 3 and the detachable head strap 5 are to be attached to the protective mask 1) and an unlocked position (when it is desirable to separate the lens 3 and head strap 5 from the mask 1).

Figures 6A, 6B, 6C:
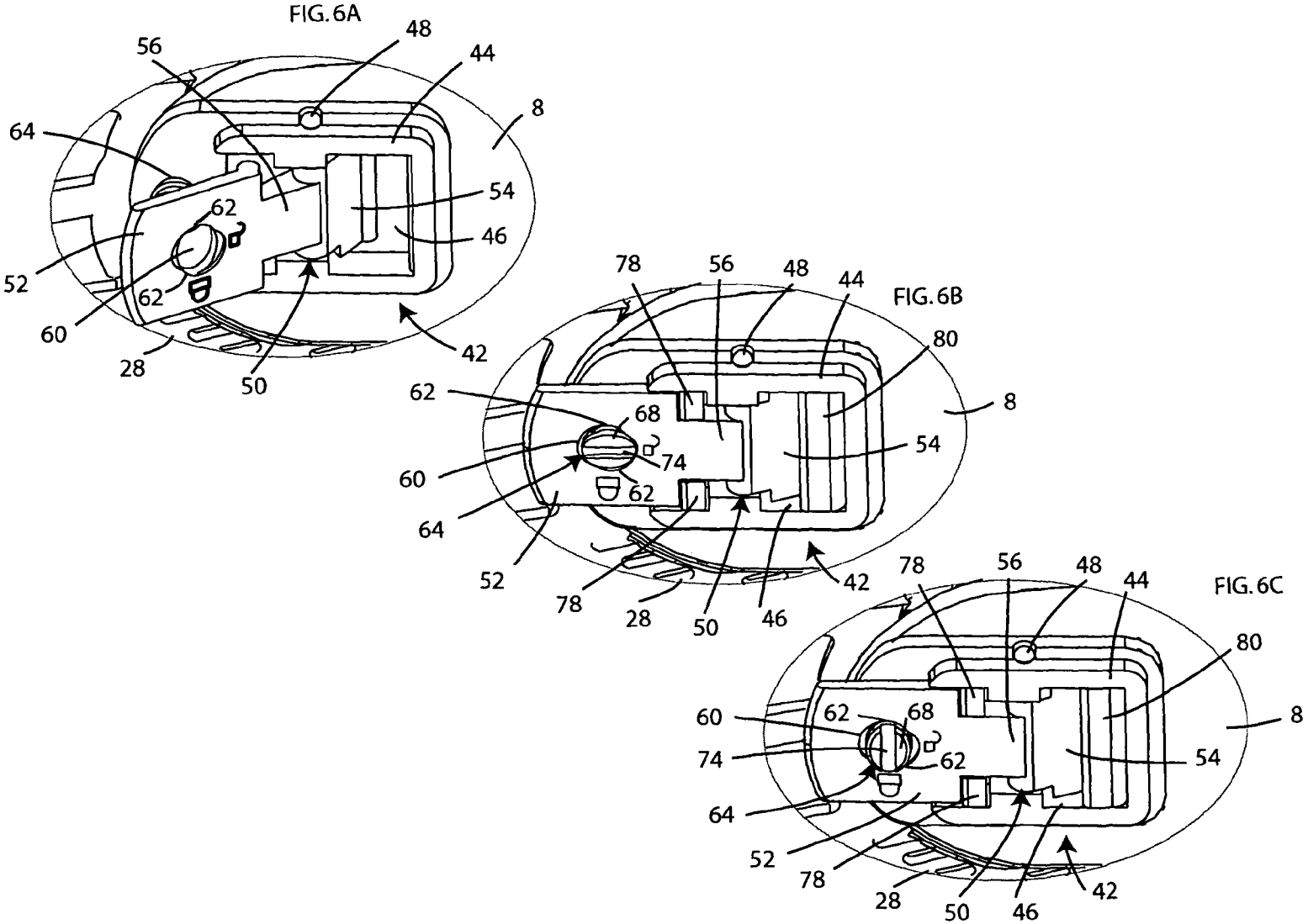
FIGS. 6A, 6B, and 6C illustrate the steps by which the second connector of FIG. 5 is manipulated inside the mask so as to be mated to the first connector.

FIGS. 6A-6C of the drawings illustrate the steps by which a first connector (designated 40 in FIGS. 3A and 4) to which one end of the head strap 5 is tied is moved inwardly through an axially aligned ear hole 30 in the ear covering section 28 of the protective mask 1 and a head strap connection hole 14 in the ear covering section 8 of lens 3 so as to be coupled to a quick-release second connector 42 (of FIG. 5) inside the mask in order to hold the removable lens 3 and detachable head strap 5 in place during play. More particularly, FIG. 6A shows the latch 50 of quick-release connector 42 in its unlatched position with the force-receiving pad 52 thereof rotated around pin 48 and lifted off the locking screw 64 carried by the base 44 prior to the first and second connectors 40 and 42 being coupled to one another. In this case, the force-responsive tail 54 which lies opposite the force receiving pad 52 projects downwardly through the window 46 in base 44 so as to be disengaged from the first connector 40.

In FIG. 6B, the first connector 40 is now coupled to the second quick-release connector 42, such that the upstanding neck support fingers 78 and the locking catch 80 of the first connector 40 are moved into the window 46 that is surrounded by the base 44 of the second connector 42. At this point, the force receiving pad 52 of latch 50 is rotated downwardly (in response to a manual pushing force applied thereto) around pin 48 to the latched position so as to lie against the base 44 such that the oval-shaped head 68 of the locking screw 64 that is received by the base 44 is also received through the oval-shaped hole 60 in the force-receiving pad 52. In this case, the force-responsive tail 54 of latch 50 is correspondingly rotated upwardly within the window 46 of base 44 so as to move into interlocking engagement below the hook shaped locking catch 80 that projects from the first connector 40 into the window 46 of the second connector 42 (best shown in FIG. 4). At the same time, the neck 56 between the force-receiving pad 52 and force-responsive tail 54 of latch 50 is received in the space between the neck support fingers 78 of the first connector 40.

In FIG. 6B, the oval-shaped head 68 of locking screw 64 is disposed in the unlocked position with respect to the oval-shaped hole 60 formed in the force receiving pad 52. That is, the oval-shaped head 68 is aligned along the major axis of the oval-shaped hole 60 so as to lie out of receipt by the recessed lips 62 of hole 60.

FIG. 6C shows the oval-shaped head 68 of locking screw 64 moved to the locked position with respect to the oval-shaped hole 60 formed in the force-receiving pad 52 of latch 50. In this case, a suitable flat-edged tool or even a coin (not shown) is inserted into the force-transmitting slot 74 in the head 68 of locking screw 64. A rotational force generated by the tool within slot 74 imparts a rotational force to the head 68, whereby to cause head 68 to rotate within the oval-shaped hole 60 from the unlocked position of FIG. 6B to the locked position of FIG. 6C. That is, the oval-shaped head 68 is now aligned along the minor axis of the oval-shaped hole 60 so as to be received within the recessed lips 62 at opposite sides of the hole 60. With the head 68 of locking screw 64 rotated to the locked position as shown in FIG. 6C and captured by the recessed lips 62 of hole 60, the force-receiving pad 52 of latch 50 will be held down against the base 44 in its latched position, and the force-responsive tail 54 of latch 50 will be retained in interlocking mating engagement underneath the locking catch 80 of connector 40.

Accordingly, the first and second connectors 40 and 42 from one pair of connectors are mated to each other within the window 46 of connector 42 via an axially aligned ear hole 30 through an ear covering section 28 of protective mask 1 and a head strap connection hole 14 through an ear covering section 8 of lens 3 to reliably prevent the removable lens 3 from sliding out and the detachable head strap 5 from being separated from the mask. However, when it is otherwise desirable to quickly and easily remove the lens 3 and/or detach the head strap 5, the quick-release connector 42 is manipulated by the wearer within a few seconds in a reverse series of steps represented by FIGS. 6A, 6B and 6C. In this manner, a cracked or paint splattered lens can be removed from the mask for replacement without a prolonged stoppage of play.

That is to say, the head 68 of locking screw 64 is first rotated from the locked position (of FIG. 6C) to the unlocked position (of FIG. 6B). The force-receiving pad 52 of latch 50 can then be pushed upwardly and off the base 44 of connector 42 (as shown in FIG. 6A). Hence, the force-responsive pad 54 of latch 50 will be correspondingly rotated downwardly through window 46 and out of its former engagement with the locking catch 80 of connector 40. With the latch 50 now in its unlatched position, the quick-release connector 42 can be lifted off and uncoupled from the first connector 40 to which one end of the head strap 5 is tied. Finally, the first connector 40 is pulled outwardly from the head strap connection hole 14 in the ear covering section 8 of lens 3 and the ear hole 30 in the ear covering section 28 of protective mask 1 to enable the lens 3 and head strap 5 to be separated from the mask.

The invention claimed is:

1. A protective mask to be worn to protect the face of a wearer, said protective mask comprising:

a mask body having a nose covering section, a cheek covering section located at each side of said nose covering section, and a pair of ear covering side sections, each of said pair of ear covering side sections having an ear hole formed therethrough;

a removable lens attached to said mask body to cover the eyes of the wearer, said removable lens having a pair of head strap connection holes formed therethrough, said mask body and said removable lens lying adjacent one another such that the ear holes through said ear covering side sections of said mask body are axially aligned with respective ones of said pair of head strap connection holes through said removable lens;

a detachable head strap attached to said mask body to hold the protective mask on the face of the wearer; and a first connector attached to one end of said head strap and a second connector to be coupled to said first connector, said first and second connectors moving into mating engagement with one another through the axially-aligned head strap connection holes and the ear holes of said removable lens and said mask body to prevent said lens from being removed from said mask body and said head strap from being detached from said mask body.

2. The protective mask recited in claim 1, wherein each cheek covering section of said mask body includes a downwardly sloping wall that is covered by said removable lens attached to said mask body, said downwardly sloping wall being of sufficient length to provide the wearer with a substantially vertical line of sight through said removable lens without the wearer having to bend his head.

3. The protective mask recited in claim 1, also comprising a rib formed in said mask body along the bottom of each cheek covering section thereof, said removable lens attached to said mask body being seated on each rib, said rib forming a barrier to prevent liquids and solid debris from an exploding paintball from passing under said removable lens and affecting the vision of the wearer.

4. The protective mask recited in claim 1, further comprising a visor having a set of locking detents projecting therefrom and said mask body having a set of locking slots formed therein, said set of locking detents being received within respective ones of said set of locking slots by which said visor is connected to said mask body so as to extend outwardly therefrom above said removable lens.

5. The protective mask recited in claim 1, wherein said removable lens has a pair of ear covering side sections located at opposite sides thereof, said pair of head strap connection holes formed through respective ones of said pair of ear covering side sections of said removable lens.

6. The protective mask recited in claim 5, wherein said mask body has a pair of lens guiding gaps formed in said pair of ear covering side sections thereof, said pair of ear covering side sections of said removable lens being slidably received through respective ones of said pair of lens guiding gaps, such that such pair of ear covering side sections of the mask body and said pair of ear covering side sections of the removable lens lie in face-to-face alignment with one another.

7. The protective mask recited in claim 1, wherein said first connector has a locking catch projecting therefrom and extending into the axially aligned ear holes formed through the ear covering side sections of said mask body and said pair of head strap connection holes formed through said removable lens, said second connector moving into said mating engagement with said first connector at said locking catch thereof so as to prevent a disconnection of said first and second connectors from one another.

8. The protective mask recited in claim 7, wherein said second connector includes a latch having a force-receiving end and a force-responsive end, a pushing force applied to the force-receiving end of said latch causing the force-responsive end thereof to move into the said mating engagement with the locking catch of said first connector.

9. The protective mask recited in claim 8, wherein said second connector also includes a base, a window formed in said base, and a pin connected to said base and extending through said window, the latch of said second connector being coupled to and rotatable around said pin, whereby the force-responsive end of said latch rotates relative to said window and into the said mating engagement with the locking catch of said first connector in response to said pushing force applied to the force-receiving end of said latch.

10. The protective mask recited in claim 9, further comprising a lock carried by the base of said second connector for engaging the force-receiving end of said latch after the force-response end thereof rotates into the said mating engagement with the locking catch of said first connector, said lock being movable from a locked position at which to hold said force-receiving end and thereby prevent a rotation of said force-responsive end out of engagement with said locking catch to an unlocked position at which to release said force-receiving end and thereby permit a rotation of said force-responsive end out of engagement with said locking catch.

11. The protective mask recited in claim 10, wherein said lock is carried by and rotatable relative to the base of said second connector between said locked and unlocked positions, said lock engaging the force-receiving end of the latch of said second connector by way of a hole formed through said force-receiving end.

12. The protective mask recited in claim 11, wherein said lock carried by said base has a locking head that is rotatable with said lock between said locked and unlocked positions, said locking head being rotatable within the hole formed through the force-receiving end of said latch for locking said force-receiving end to said base and thereby preventing a rotation of said force-responsive end when said lock is rotated to the locked position.

13. The protective mask recited in claim 12, wherein each of the hole formed through the force-receiving end of said latch and the locking head of said lock has an oval shape, such that said hole has a major axis and a minor axis, said lock being rotated to the locked position when the oval-shaped locking head thereof is correspondingly rotated so as to lie along the minor axis of said oval-shaped hole, and said lock being rotated to the unlocked position when the oval-shaped locking head is correspondingly rotated so as to lie along the major axis of said oval-shaped hole.

14. The protective mask recited in claim 13, wherein the oval-shaped hole formed through the force-receiving end of the latch of said second connector has a recessed lip at each of the opposite sides thereof lying along the minor axis of said hole, the oval-shaped locking head of said lock being received by said recessed lips when said lock is rotated to the locked position.

15. The protective mask recited in claim 13, wherein the locking head of said lock has a force-transmitting slot at which to receive a rotational force, said rotational force causing said lock to rotate between said locked and said unlocked positions.

16. A protective mask to be worn to protect the face of a wearer, said protective mask comprising:

a mask body;

a removable lens attached to said mask body to cover the eyes of the wearer;

a detachable head strap attached to said mask body to hold the protective mask on the face of the wearer; and a first connector attached to one end of said head strap and a second connector to be coupled to said first connector, said first and second connectors being moved into mating engagement with one another through openings formed in each of said removable lens and said mask body, said first connector including a locking catch projecting therefrom and extending into the openings formed in said mask body and said removable lens, said second connector moving into said mating engagement with said first connector at said locking catch thereof so as to prevent a disconnection of said first and second connectors from one another, and said second connector including a latch having a force-receiving end and a force-responsive end, a pushing force applied to the force-receiving end of said latch causing the force-responsive end thereof to move into said mating engagement with the locking catch of said first connector.

17. The protective mask recited in claim 16, wherein said second connector also includes a base, a window formed in said base, and a pin connected to said base and extending through said window, the latch of said second connector being coupled to and rotatable around said pin, whereby the force-responsive end of said latch rotates relative to said window and into said mating engagement with the locking catch of said first connector in response to said pushing force applied to the force-receiving end of said latch.

18. The protective mask recited in claim 17, further comprising a lock carried by the base of said second connector for engaging the force-receiving end of said latch after the force-response end thereof rotates into said mating engagement with the locking catch of said first connector, said lock being movable from a locked position at which to hold said force-receiving end and thereby prevent a rotation of said force-responsive end out of engagement with said locking catch to an unlocked position at which to release said force-receiving end and thereby permit a rotation of said force-responsive end out of engagement with said locking catch.

19. The protective mask recited in claim 18, wherein said lock is carried by and rotatable relative to the base of said second connector between said locked and unlocked positions, said lock engaging the force-receiving end of the latch of said second connector by way of a hole formed through said force-receiving end.

20. The protective mask recited in claim 19, wherein said lock carried by said base has a locking head that is rotatable with said lock between said locked and unlocked positions, said locking head being rotatable within the hole formed through the force-receiving end of said latch for locking said force-receiving end to said base and thereby preventing a rotation of said force-responsive end when said lock is rotated to the locked position.

* * * * *